US005669448A

United States Patent [19]

Minthorn et al.

[11] Patent Number: 5,669,448

[45] Date of Patent: Sep. 23, 1997

[54] OVERBALANCE PERFORATING AND STIMULATION METHOD FOR WELLS

[75] Inventors: James W. Minthorn, Mount Pleasant, Mich.; Kevin T. Berscheidt, Duncan, Okla.; Brian R. White, Traverse City, Mich.; Ronald E. Savage, Duncan, Okla.; Merlin F. Anderson, Shreveport, La.; Dudley Vann, Tyler, Tex.; Flint Raymond George, Flower Mound, Tex.; Joseph A. Henke, Lewisville, Tex.; Joseph M. Prudhomme, Shreveport, La.

[73] Assignee: Halliburton Energy Services, Inc., Duncan, Okla.

[21] Appl. No.: 569,822

[22] Filed: Dec. 8, 1995

[51] Int. Cl.[6] ..... E21B 43/26

[52] U.S. Cl. ..... 166/308; 166/177.5

[58] Field of Search ..... 166/280, 308, 166/177.5

[56] References Cited

U.S. PATENT DOCUMENTS

| | | | |
|---|---|---|---|
| 2,753,940 | 7/1956 | Bonner | 166/777.5 X |
| 2,973,035 | 2/1961 | Brown | 166/308 X |
| 3,011,551 | 12/1961 | Young et al. | 166/308 |
| 3,170,517 | 2/1965 | Graham et al. | 166/42 |
| 3,627,045 | 12/1971 | Lebourg | 166/308 X |
| 4,633,951 | 1/1987 | Hill et al. | 166/308 |
| 4,718,493 | 1/1988 | Hill et al. | 166/308 |
| 4,793,417 | 12/1988 | Rumbaugh | 166/312 |
| 5,005,649 | 4/1991 | Smith et al. | 166/177.5 X |
| 5,131,472 | 7/1992 | Dees et al. | 166/308 |
| 5,156,213 | 10/1992 | George et al. | 166/297 |
| 5,303,772 | 4/1994 | George et al. | 166/55.1 |
| 5,366,014 | 11/1994 | George | 166/297 |
| 5,472,050 | 12/1995 | Rhoten et al. | 166/308 X |

*Primary Examiner*—William P. Neuder
*Attorney, Agent, or Firm*—Robert A. Kent

[57] ABSTRACT

A method of stimulating a well subsequent to the formation of perforations whereby, subsequent to the perforating, pressure is suddenly applied to the perforations at a pressure above the fracturing pressure to extend created fractures in the formation. A bridging means is utilized to isolate the upper portion of the casing from a lower portion having perforations. The casing above the bridging means is charged with a stimulation fluid. At a predetermined pressure the bridging means releases the stimulation fluid into contact with the perforations to substantially simultaneously create or initiate a fracture into the formation from each perforation.

36 Claims, 7 Drawing Sheets

OVERBALANCE PERFORATING AND STIMULATION METHOD FOR WELLS

BACKGROUND OF THE INVENTION

1. Field of the Invention

This invention relates to a method of stimulating or increasing the rate of fluid flow into or out of a well. More particularly, this invention relates to a method of perforating a well wherein the formation around the perforations is fractured and the fractures are propagated by high pressure injection of one or more fluids.

2. Description of Related Art

Well stimulation refers to a variety of techniques used for increasing the rate at which fluids flow out of or into a well at a fixed pressure difference. For production wells, it is important to increase the rate such that production of the well is more economically attractive. For injection wells, it is often important to increase the rate of injection at the limited pressure for which the well tubular equipment is designed.

The region of the earth formation very near the wellbore is very often the most important restriction to flow into or out of a well, because the fluid velocity is greatest in this region and because the permeability of the rock is damaged by drilling and completion processes. It is particularly important to find means for decreasing the resistance to flow through this zone.

Processes which are normally used for decreasing the fluid flow resistance near a wellbore are of two types. In one type, fluids such as acids or other chemicals are injected into a formation at low rates and interact with the rock matrix to increase permeability of the rock. In another type, fluid pressure is increased to a value above the earth stress in the formation and the formation rock fractures. Injection of fluid at a pressure above the fracturing pressure then is used to propagate the fracture away from the wellbore. Solid particles, called proppant, can be added to the fracturing fluid to maintain an Open channel in the fracture after injection of fluid ceases and the fracture closes. Alternatively, if the formation contains significant amounts of carbonate rock, an acid solution not containing proppant is injected at fracturing pressures to propagate the fracture, in a process called fracture acidizing.

The effectiveness of fracturing or other well stimulation methods in decreasing flow resistance near a well is often measured by reference to a "skin factor." Skin factors are measured by measuring bottomhole pressures in a well under differing flow conditions. A positive skin factor indicates that the region around the wellbore is more resistive to flow than the formation farther away from the well. Likewise, a negative skin factor indicates that the near wellbore region has been made less resistive to flow than the formation. This lower resistance can be a result of a fracture or fractures created near the well and intersecting the wellbore or the result of changes in rock permeability near the wellbore.

A variety of methods have been proposed to create relatively short fractures to decrease near wellbore resistance to flow. Of course, the obvious method is to perform a conventional hydraulic fracturing treatment but pump less quantities of fluid and proppant. Unfortunately, the cost of assembling the equipment for such small jobs limits the usefulness of this technique. Other processes have been proposed. U.S. Pat. No. 4,633,951 discloses use of combustion gas generating units and a cased wellbore filled with compressible hydraulic fracturing fluid, such as foam, containing proppant particles. The pressure of the compressible fluid is increased to a pressure in excess of the fracturing pressure of the formation-sometimes far in excess. The casing of the wellbore then is perforated to release the compressible fluid and particles through the perforations at high pressures. The fractures formed become plugged with proppant particles. U.S. Pat. No. 4,718,493, a continuation-in-part of the '951 patent, discloses continued injection of the compressible fracturing fluid after perforating the casing until fluid leak-off caused proppant to plug the fracture back to the wellbore. Proppant at moderate to high concentrations in the fracturing fluid is proposed.

U.S. Pat. No. 3,170,517 discloses a method of creating a relatively small hydraulic fracture from a wellbore by placing a fracturing fluid, which may be an acid or may contain proppant, in a well, building up gas pressure above the fracturing fluid, and perforating the casing of the well. Fracturing pressure of the formation is applied from the gas only until the gas pressure is depleted by flow from the wellbore.

Most wells for hydrocarbon production contain steel casing which traverses the formation to be produced. The well is completed by perforating this casing. Two explosive types of perforating equipment are commonly used: (1) shaped charges, and (2) high-pressure jets of fluid. The shaped-charge gun is by far the most common. The perforation formed must penetrate the steel casing and preferably will penetrate the zone of damaged permeability which often extends for a few inches around a wellbore as a result of processes occurring during drilling of the hole. The most common method of placing perforating apparatus in a well is attaching it to an electrically conducting cable, called an "electric wire line." This type perforating gun can be run through tubing in a well to perforate casing below the tubing; or in casing only. In recent times, a method of perforating called "tubing-conveyed perforating" has been developed. In this method, apparatus is attached to the bottom of the tubing before it is run into a well and the firing of the charges is initiated by dropping of a bar down through the tubing or by a pressure-activated firing device. Vent valves, automatic dropping of the gun from the bottom of the tubing after firing and other features can be used along with tubing-conveyed perforating.

The use of high pressure gas or other fluid in a wellbore to clean perforations has been described in U.S. Pat. No. 5,131,472. The reference discloses a method of stimulating a well by suddenly applying pressures to the formation in excess of the fracturing pressure and thereafter pumping fluid into the well before the pressure declines below the fracturing pressure. The fluid pumped after the initial fracturing may include proppant.

While there have been a variety of methods proposed for creating small hydraulic fractures and for cleaning perforations around a wellbore, there has remained a need for an economical method which creates a pattern of high-pressure fractures extending from all the perforations into a formation.

SUMMARY OF THE INVENTION

The present invention provides a method of stimulating a well whereby subsequent to the formation of perforations through the casing in the wellbore, pressure is suddenly applied to the perforations at a pressure level above the fracturing pressure of the formation and pumping is continued to extend created fractures or place proppant in the fractures. In accordance with the invention, a well is completed with casing cemented in place. Perforations are formed through the casing by conventional means. During perforating, a fluid, including acid or brine, may be spotted in the wellbore to cover the zone of interest in the formation that is perforated. A bridging means capable of sealing the upper portion of the casing from the lower portion is positioned in the casing above the perforations. The casing above the perforations is charged with a stimulation fluid, typically an energized compressible fluid including nitrogen gas. At a predetermined pressure, the bridging means vents or releases the stimulation fluid into contact with the perforations while at a pressure above the fracturing pressure of the formation. The bridging means also may comprise a portion of a tubing conveyed or wireline conveyed perforating gun assembly which is capable of isolating the upper casing from the lower casing.

The invention may be used in a manner such that the bridging means, which can be set above the TCP gun, releases virtually simultaneously with the firing of the TCP gun, allowing the stimulation fluids to enter the newly formed perforations immediately after their creation. In such an embodiment, a firing head can be used that is activated simultaneously with the firing of the gun, the firing head being capable of causing the bridging means to release.

The inventive method and apparatus may also be used when existing perforations are being reperforated, or when new perforations are being added to a well with existing perforations, by setting the bridging means above the perforations, adding stimulation fluids under pressure above the bridging means to a pressure in excess of the pressure required to fracture the formation, and then releasing the bridging means. The inventive method and apparatus may also be used with downhole pressure measurement devices, to allow for tracking pressure changes during the stimulation operation.

DESCRIPTION OF THE PREFERRED EMBODIMENTS

Figure 1:
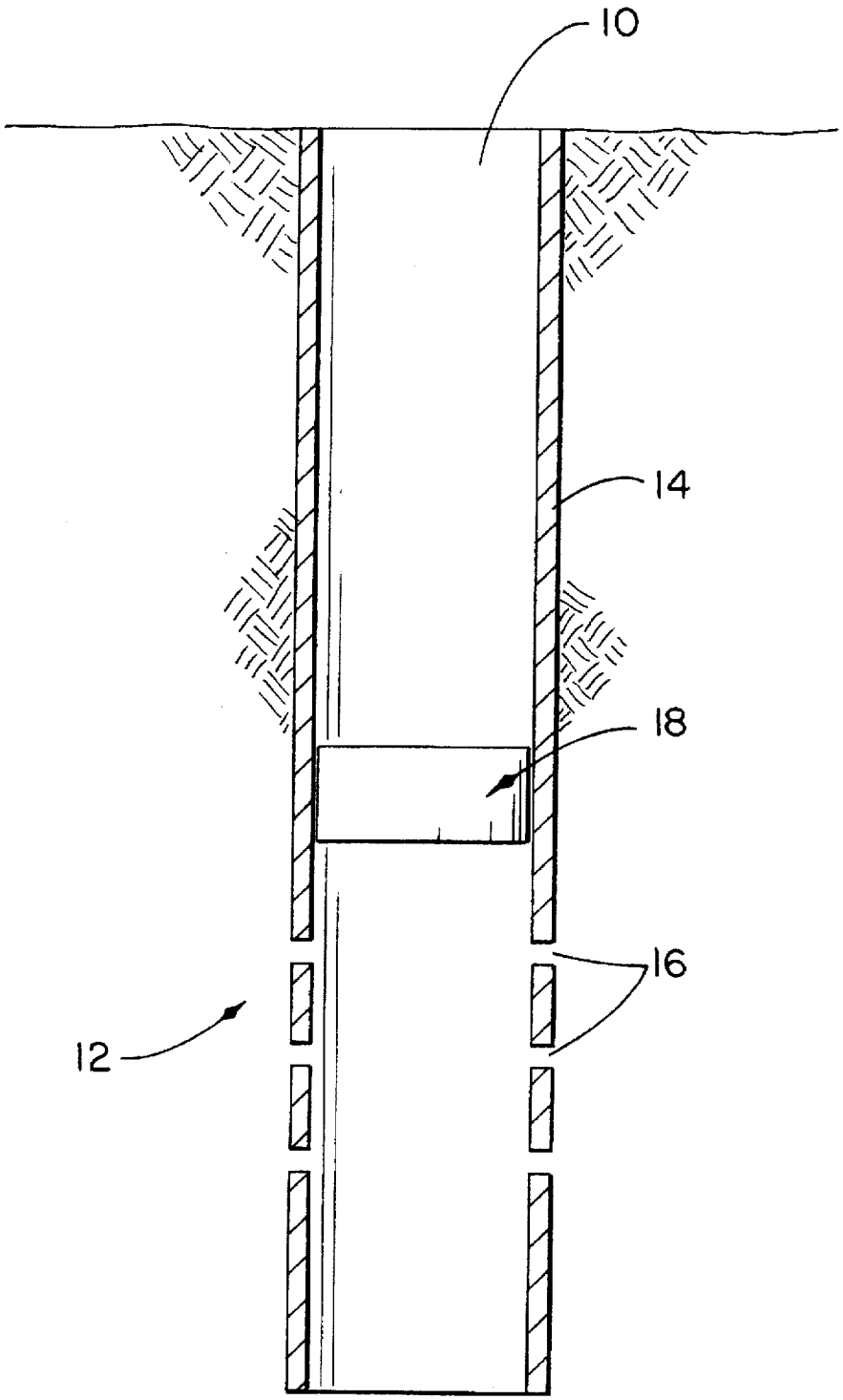
FIG. 1 is a schematic illustration of a wellbore in which the method of the present invention is employed

Referring now to FIG. 1, a cased well 10 is illustrated which penetrates a formation 12 from which hydrocarbons are to be produced. Although well 10 is illustrated as being in a vertical direction, it is to be understood that the well can be at substantially any angle, including horizontal, and the method of the present invention may still be employed as will be well understood by those individuals skilled in the art. Techniques for drilling wells are well known in the art and do not comprise a part of the present invention.

Casing 14 is placed in the wellbore 10 after drilling. Casing 14 is cemented in place with cement (not shown) to isolate the various formations along the length of the casing 14 in the subterranean formation. Casing 14 includes perforations 16 formed at a zone of interest in the subterranean formation. The perforations may be formed by any conventional means such as electric wireline conveyed shaped charges. Alternatively a hydro-jetting tool may be utilized to cut holes or slots into casing 14 to effect communication with formation 12. The perforating may be effected in the presence of a fluid that is spotted in the casing in the interval over which perforations 16 are formed. The fluid, when present, may comprise a gas, a brine or an acidic fluid, such as a 3–15% hydrochloric acid solution or the like. Perforating in the presence of a spotted fluid without overpressure above that of the formation generally is referred to as neutral balance perforating in which there is no significant movement of fluids into or out of the formation perforations as a result of perforating the formation. This is in contrast to overbalance perforating in which the casing is overpressured above that of the formation prior to perforating such that wellbore fluids flow into the formation immediately upon perforating and under-balanced perforating in which the casing contains no fluid or fluids having a density such that the pressure within the casing is less than the pressure exerted on the casing by formation fluids that are present and which flow into the casing immediately upon creation of the perforations. Preferably, the perforating is effected under either neutral balance or under-balanced conditions.

A bridging means 18 is set in the casing 14 above the perforations 16. In one embodiment, the bridging means 18 is set after formation of the perforations 16. In an alternate embodiment, the bridging means 18 may be integrally connected with the perforating equipment and may be positioned within casing 14 prior to the formation of the perforations 16. In a further embodiment bridging means 18 may be fashioned to allow the bridging means to be installed in production tubing that has previously been installed in the casing 14. Therefore reference to casing 14 herein should be construed to include production tubing when practicing the present invention in wellbores having such production tubing in place. When casing 14 extends substantially below the zone of interest in formation 12, a plug (not shown) which may be either temporary or permanent can be set in the lower portion of casing 14 below the perforations 16 to isolate the zone of interest in formation 12 from lower zones. The design and installation of such plugs is well known in the art and does not comprise a part of the present invention.

Figure 2:
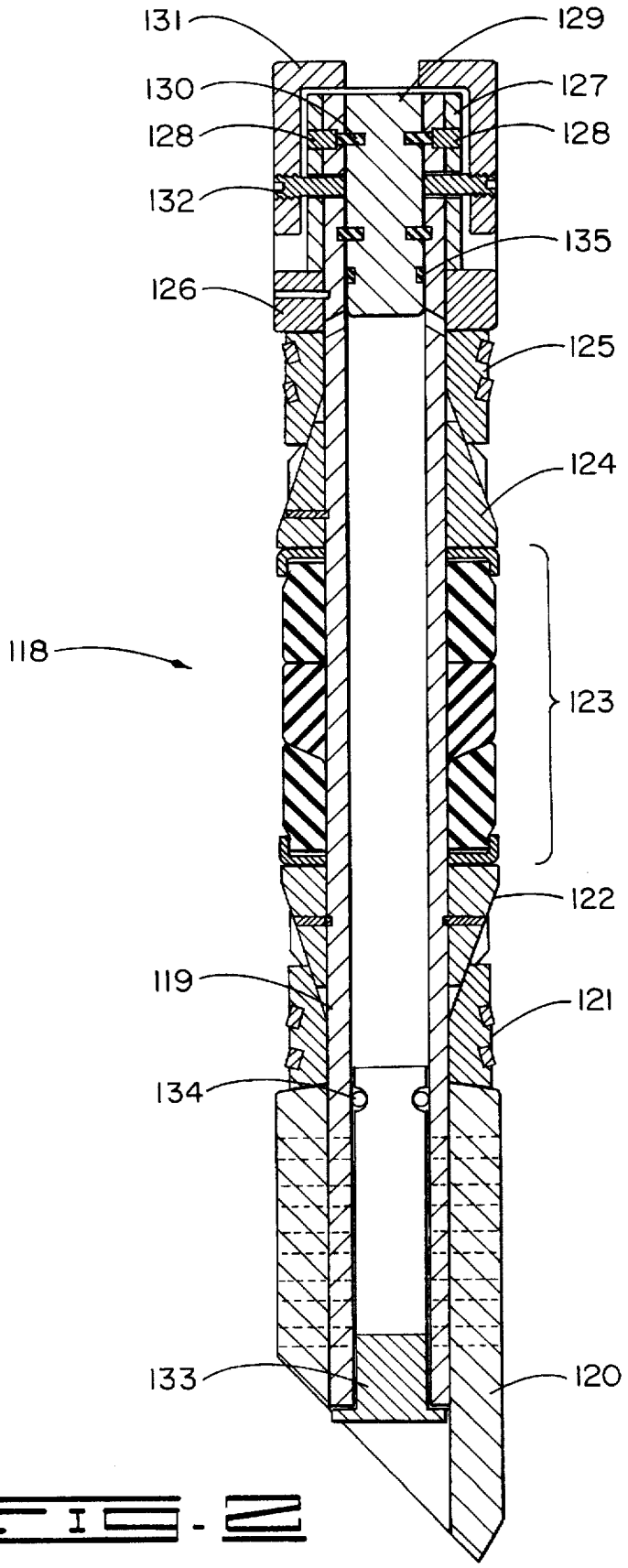
FIG. 2 is a schematic illustration of bridging means of the present invention

In FIG. 2 of the drawings, a representative bridging means in the form of a modified bridge plug type downhole tool is shown in cross-section. The basic version of bridge plug 118 is marketed by the assignee of the present invention under the trademark FAS DRILL which employs essentially all non-metallic components to facilitate drilling and to reduce drill out time to a minimum. However, bridge plugs made of conventional metallic materials may be used as well.

The particular structure of bridge plug 118 as modified for practicing the present invention includes a mandrel 119 that has a mule shoe 120 pinned to the bottom of mandrel 119, a bottom slip 121 and coacting slip wedge 122 located about mandrel 119, a packer element assembly 123 located about mandrel 119, an upper slip wedge 124 and coacting slip 125 located about mandrel 119, a hub 126 located about mandrel 119, an outer sleeve 127 located about and pinned to mandrel 119 by pins 127, a temporary plug 129 which is located and secured within mandrel 119 by shear pins 130, an o-ring 135 providing a seal between plug 129 and the bore of mandrel 119, and a setting tool 131 attached to sleeve 127 by shearable screws 132. Preferably, bridge plug 118 is provided with a protective bottom plug 133 installed near the lower most end of mandrel 119 and preferably extends within mandrel 119 and is secured thereto by way of coacting threads, adhesive, interference fit, pins or any other suitable temporary retention means. Bottom plug 133 is also provided with an O-ring seal 134 to seal the bore of mandrel 119.

Generally, the operation of bridge plug 118 consists of selecting and installing the requisite number of shear pins 130, made of a preselected material such as brass and having a cross-sectional area so as to allow plug 129 to be forced toward the bottom of the bore of the mandrel upon pressurizing the stimulation fluid in the casing above the plug to a desired pressure thereby shearing pins 130 when practicing the present invention. Such temporary releasable plug 129 serves as a pressure release means.

More specifically, upon reaching the desired pressure uphole, and upon shear pins 130 being sheared, plug 129 along with the pressurized stimulation fluid, travels down the bore of the mandrel, which is approximately at atmospheric pressure or less, and forcefully impacts protective plug 133. Thereafter the fluid, plug 129, and plug 133 travel down the wellbore below the tool and the stimulation of the formation in accordance to the present invention is carried out. A benefit of using a protective plug 133 is that should an underbalance condition exist for any reason prior to pressurizing the stimulation fluid in the casing above bridge plug 118, such as having uphole pressure of 3000 psi, and there is a 1000 psi pressure in the wellbore below bridge plug 118, and the bridge plug to be used did not have a protective plug 133, the uphole pressure would have to be increased to 4000 psi in order to offset the 1000 psi downhole pressure in order to shear pins 130 which were selected to shear at 3000 psi. Thus, the typically atmospheric pressure within the volumetric cavity within the bore of mandrel 119 defined by the distance between the lowermost portion of plug 129 and the uppermost portion of protective plug 133 and the I.D. of the bore, allows plug 129 to be disengaged from the mandrel at a predetermined uphole pressure regardless of the wellbore pressure below the bridge plug tool. Upon the now disengaged plug 129 reaching protective plug 133, plug 129 will disengage plug 133 if the pressure of the stimulation fluid above plug 133 is greater than the pressure of the formation fluid existing below plug 133, less whatever force is necessary to overcome the temporary installation of plug 133 in the mandrel.

Therefore, when practicing the present invention it is recommended that a protective plug 133, or other easily releasable temporary barrier to provide a volumetric cavity be used when utilizing a bridge plug type tool, such as the representative tool 118 depicted and discussed herein. It should be noted that the depicted tool 118 is merely exemplary and that other bridge plug type tools known within the art may also be adapted to practice the present invention without departing from the scope and spirit of the claims.

Figure 3:
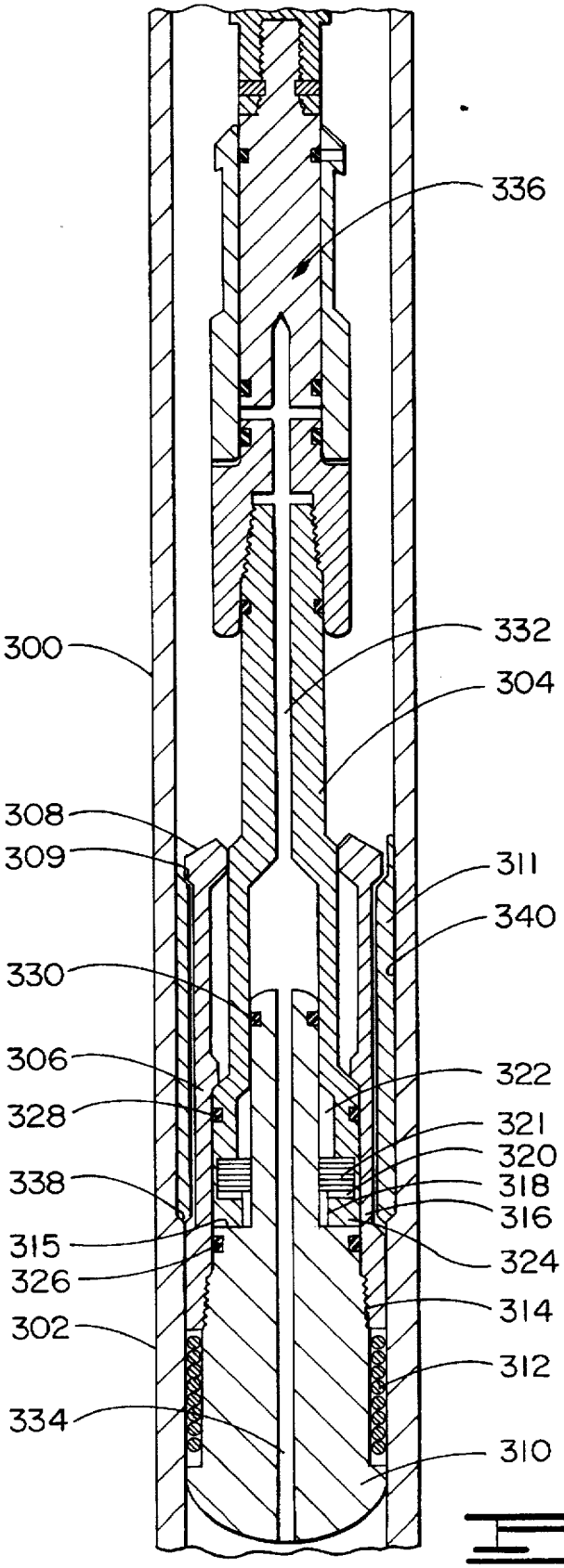
FIG. 3 is a schematic illustration of an alternative mode of the present invention

A further embodiment of bridging means 18 for use in wellbores having a production tubing installed therein is shown in FIG. 3 of the drawings. FIG. 3 is a cross-sectional view of a portion of a production tubing string 300 having a landing nipple tool 302 installed therein as is known in the art. Such exemplary landing nipple tools include X and R landing tools available from Halliburton Energy Services. A releasing mandrel 304 is provided which will be accommodated by a collet 306 having distal collet fingers 308 being configured to engage with a landing portion 309 of an optional landing sleeve 311 and to engage with the outer surface of mandrel 304. Should the use of optional landing sleeve 311 not be desired, collet fingers 308 could be configured to engage with an alternative landing portion 338 located within longitudinal bore 340 of nipple tool 302. A plug body 310 is provided with a circumferential seal 312, known within the art, to provide a hydraulic seal between the plug body and bore 340 of nipple tool 302. Plug body 310 is preferably secured to collet 306 by way of a shear set assembly 316. Shear set 316 includes a smaller diameter ring 318 which is partially nested within a larger diameter ring 320. Both rings are installed about a reduced upper portion of plug body 310 and the smaller diameter ring 318 rests upon a shoulder 315 of plug body 310. Shearable fasteners such as shearable pins 321 are inserted with prealigned holes that pass radially through rings 318 and 320. Void 320 allows larger ring 320 to slide downward upon sufficient pressure being applied above mandrel 304 which causes shearable fasteners 321 to shear at a preselected pressure. Void 322 allows the lower portion of mandrel 304 to pass by smaller ring 318 upon the shearable fasteners being sheared at such preselected pressure. Seals 326, 328 and 330 serve to provide hydraulic seals between the respectively located elements of the tool to prevent unwanted pressure drops above and below the bridging means being described. Longitudinal equalizer passageways 332 and 334 of mandrel 304 and plug body 310, respectively, provide a means of equalizing hydrostatic pressure when pulling the bridging means from the hole if, for what ever reason, it is desired that the bridging means be removed prior to conducting the stimulation process described herein. Setting tool 336, used to initially install this particular bridging means shown in FIG. 3, may be provided with a fishing neck known within the art to facilitate the removal of this particular bridging means if it is decided not proceed with the stimulation process described herein. It may also may be desirable to provide a securing means, not shown, between the upper portion of mandrel 304 and collet fingers 308 to augment the securement thereof should it be necessary to fish the plug, mandrel, and optional sleeve from the landing nipple tool. Generally, the described components can be made of steel or of a material having adequate structural characteristics to perform the required tasks.

Upon the requisite pressure above mandrel 304 being obtained in accordance with the present invention, shearable fasteners 321 fail, and both the mandrel and plug body 310 are quickly pumped through nipple landing tool 302 and subsequently through production casing 300 extending therebelow in order that the stimulation fluid can proceed as further described herein.

It will be appreciated that by using the preceding bridging means for wells having production tubing therein, considerable costs can be saved in not having to pull the production tubing while still providing a sufficiently large nominal inside diameter within the production tubing/landing nipple tool that the nearly instantaneous passage of stimulation fluid will not be hampered, or choked, by an effectively smaller orifice that would be present if a standard known pump out plug were to be used.

A stimulation fluid is introduced by surface pumps at an elevated pressure into the casing 14 above bridging means 18 to charge the casing to a pressure sufficient to activate bridging means 18 whereby the stimulation fluid is permitted to pass bridging means 18 and suddenly contact perforations 16 while still at an elevated pressure. The pressure of the stimulation fluid is selected such that upon contact of the fluid with perforations 16 or fluid in casing 14 in contact with such perforations, the pressure of the fluid is above the pressure level necessary to achieve fracturing in formation 12 in the zone of interest. As the stimulation fluid enters perforations 16 from casing 14, and before the pressure can decline below the fracturing pressure, such that the created fractures close, additional fluid is introduced by pumps at the surface into the casing 14 to continue and extend fractures produced by the sudden contact of the stimulation fluid with the subterranean formation through perforations 16. The time required for the high pressure fractures to close will depend on the fluid leak-off rate into the formation and the compressibility of the fluid in casing 14. It is to be understood that brief pressure drops below fracturing pressure may occur while the stimulation fluid is pumped into formation 12 provided the created fractures do not completely close. Preferably, additional fluid is pumped into the casing 14 while the created fractures are still open to maximize the procedures effectiveness. The surface pumps are designed to pump liquids, liquids containing solid particles such as proppants, gases or liquified gases.

The method of suddenly applying pressure to existing or previously formed perforations with sufficiently high pressures present to fracture the subterranean formation is believed to create and open at each perforation a fracture. This complete diversion effect to all the perforations is believed responsible for a significant amount of the benefit achieved by the present method. The size of the created fractures then is increased by the subsequent continued injection of fluid before the fractures have closed. The subsequently injected fluid may contain any of the well known proppant materials, such as sand, glass beads, resin coated sand, calcined or sintered bauxite, resin beads or the like to prop the created fractures in at least a partially open condition at the conclusion of the treatment to increase the flow capacity of the created fractures in communication with the wellbore.

The stimulation fluid may comprise a gas, an aqueous or hydrocarbon based fluid. The aqueous fluid may comprise water, brine, acid solutions or the like and may include any of the well known viscosifiers for such fluids. The hydrocarbon fluids may comprise kerosene, diesel, lease crude or the like and also may include any of the well known viscosifiers for such fluids. The gas may comprise lease gas, nitrogen, air or the like. The stimulation fluid preferably comprises a gas-containing fluid such as an aqueous fluid containing from about 10 to about 90% by volume of a gas such as nitrogen gas whereby a foamed fluid is produced. Nitrogen gas is the preferred gas for forming a foamed fluid. The stimulation fluid also may include surfactants, foaming agents, clay stabilizers, gel breakers, bactericides and the like that do not detrimentally react with the other constituents of the fluid or the formation.

The foamed fluid minimizes the quantity of liquids introduced into the formation thereby assisting in limiting liquid fluid related damage to a formation, and the like. The gas in the foamed fluid facilitates fluid recovery after the conclusion of the treatment. Techniques for pumping liquid nitrogen, conversion of liquid nitrogen to a gas and formation of a foamed liquid at a well site are well known in the industry. The nitrogen, in a gaseous form, is admixed with a fluid, preferably comprising a viscosified aqueous solution, in an amount sufficient to form a foam and pumped through surface pumps into the casing 14 and ultimately past bridging means 18 and into formation 12. Preferably, during the continued pumping of the foamed fluid, proppant material is admixed with the foamed fluid and introduced through casing 14 into formation 12 to prop the created fractures. The proppant material may range in size from about 8 to less than 100 mesh on the U.S. Sieve Series. Preferably, the proppant is in the range of from about 16 to about 50 mesh. The concentration of particles in the foamed fluid may range from about 0 to in excess of twenty pounds per gallon.

The volume of stimulation fluid and proppant material introduced into any well will depend upon the specific conditions present in the well. A sufficient amount is pumped to clean the perforations 16 and create fractures extending into the formation for at least a few feet. Preferably proppant material is introduced into the created fracture to maintain the created flow channel in an open condition at the conclusion of the treatment.

After injection of the stimulation fluid into the formation has ceased, the well may be shut-in for a period of hours to permit the formation to close on the proppant material. Thereafter the well may be opened to production. The waiting period before opening the well to production may vary over significant ranges depending upon which viscosifiers are used in the stimulation fluid.

Figure 4A:
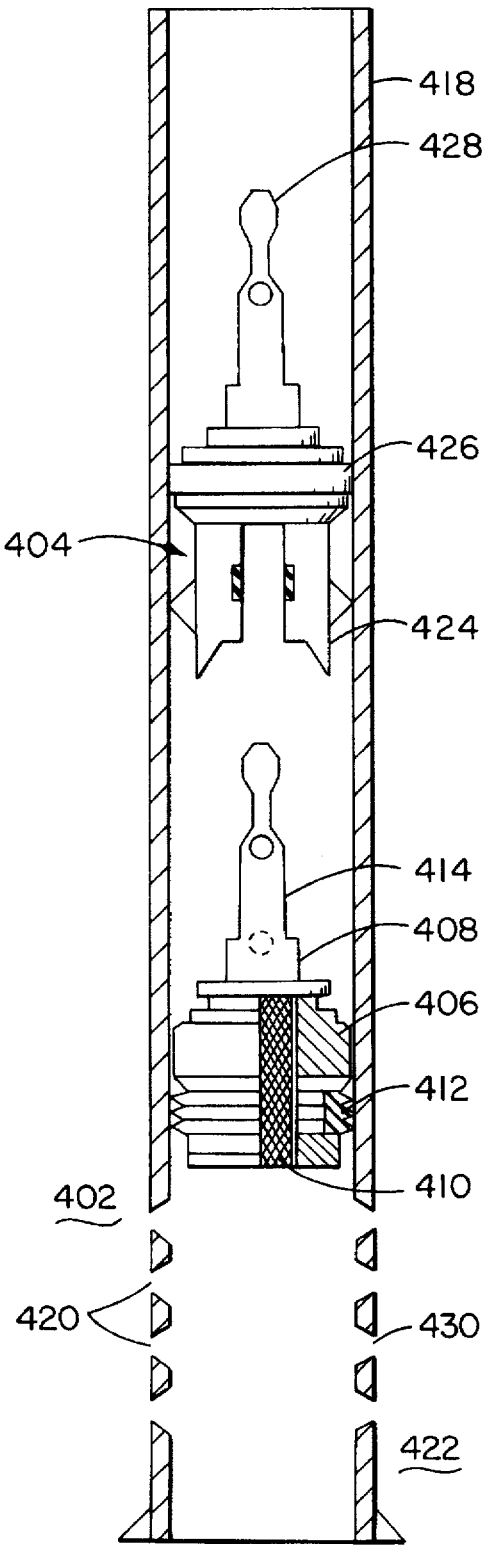
FIG. 4A, 4B & 4C is a schematic illustration of alternative means for practicing the present invention
Figure 4B:
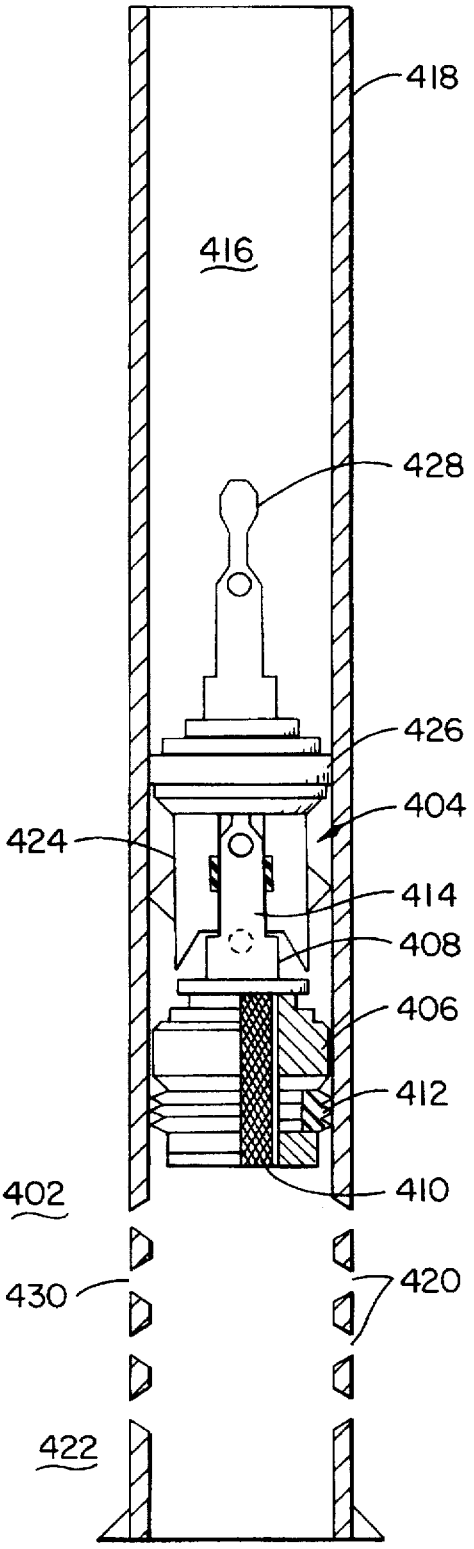
Figure 4C:
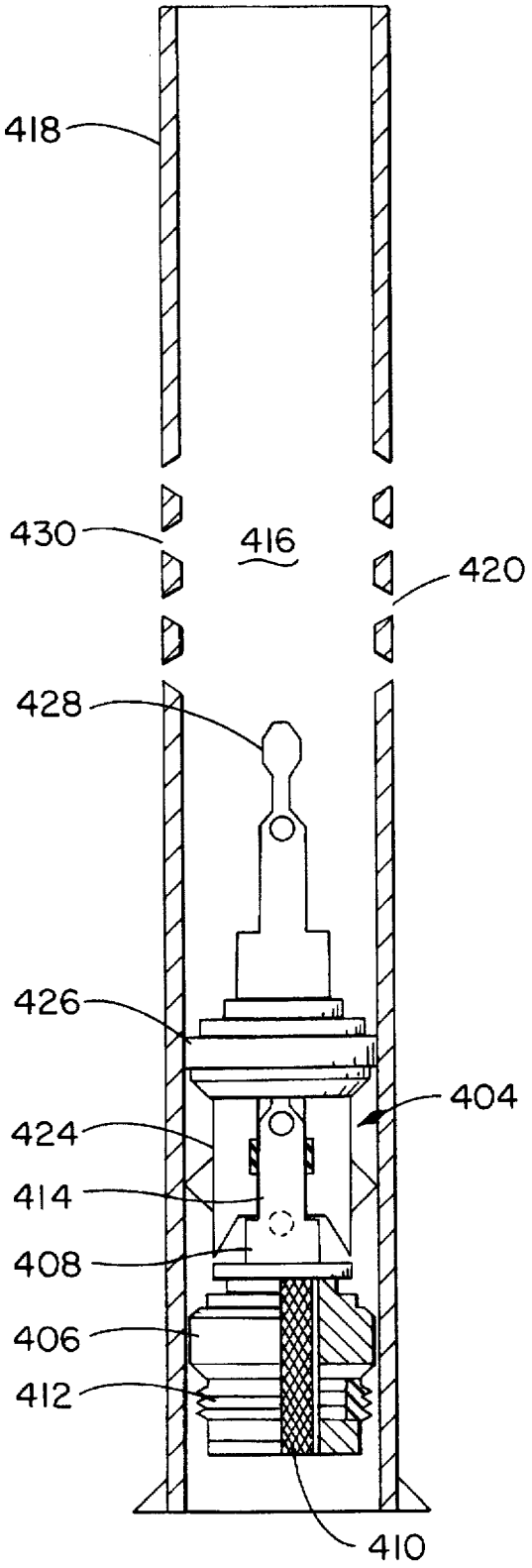

Referring now to FIG. 4A, 4B & 4C, in still another embodiment of the present invention, the pressure release means comprises a gun hanger module 402 previously referenced and bridging means 18 comprises a seal module 404. Gun hanger module 402 comprises a gun hanger 406, such as those described in U.S. Pat. Nos. 5,156,213, 5,303,772 or 5,366,014 all of which are assigned to the assignee and are incorporated herein by reference. Gun hanger 406 is used to longitudinally position and retain the gun hanger module 402 in casing 418. Attached to the top of gun hanger 406 is a firing head 408, such as a HALLIBURTON Model KV firing head. The construction and operation of such firing heads are described in U.S. Pat. Nos. 5,156,213, 5,303,772 and 5,366,014. The firing head is activated by applying and exceeding a minimum pressure to the firing head, the minimum pressure requirement being preset in the firing head prior to its being placed in the casing. For use in the inventive method, the firing head is set with a minimum pressure requirement that is greater than the pressure necessary to fracture the well. When the minimum required pressure is applied to firing head 408, firing head 408 fires, starting an explosive train which eventually sets off a shape charge 410 in gun hanger 406. The detonation of shape charge 410 in gun hanger 406 causes gun hanger slips 412 to retract and gun hanger 406 to release. When gun hanger 406 releases, the entire assembly attached thereto is pushed by the stimulation fluids under pressure downward through casing 418.

Attached atop firing head 408 is a seal nipple 414. Nipple 414 is used to attach firing head 408 to wireline or tubing, to thereby allow gun hanger module 402 to be lowered into and set in casing 418. After gun hanger module 402 is set, seal nipple 414 is used to land a seal module 404. Seal nipple 414 also allows pressure to be transmitted to firing head 408 from above the seal module 404.

Referring now to FIG. 4B, Set on top of gun hanger module 402 is seal module 404. For purposes of illustration, an embodiment in which the seal module is set above the gun hanger module is shown, but it is understood by those skilled in the art that the seal module could also be attached to the bottom of the gun hanger module, and the description of this preferred embodiment with the seal module above the gun hanger module is not intended to limit the scope of the invention in that regard. Seal module 404 serves to seal casing 418, isolating the regions above and below the seal module 404. In this way, region 416 above seal module 404 can be pressurized with stimulation fluids to a pressure sufficient to fracture formation 422 at perforations 420, and the fluids are thus held in place above seal module 404 until it is desired to allow them to move further down casing 418.

Seal module 404 comprises a seal housing 424, a cup-type packing element 426, and a stinger 428. In this embodiment, seal module 404 is attached atop gun hanger module 402 via seal housing 424. Cup-type packing element 426 sits atop seal housing 424 and is capable of sealing casing 418, and thereby preventing the flow of stimulation fluids past it, while withstanding significant pressure. Thus retained, stimulation fluids present above seal module 404 can be raised to fracturing pressure prior to their admission into perforations 420. Nipple 414 is used to lower and set seal module 404 in casing 418, and if the stimulation job is not executed for some reason, nipple 414 may be used to retrieve seal module 404.

To use this inventive apparatus, gun hanger module 402 is lowered into the well within the casing 418 to a location just above existing perforations 420, and set. Seal module 404 is then lowered into the well, set on top of gun hanger module 402 and activated, sealing casing 418 in a longitudinal direction. Stimulation fluids are then added to casing 418 above seal module 404 and pressurized to a pressure in excess of the fracturing pressure around perforations 420 but below the pressure necessary to cause firing head 408 to fire. Once pressurized to a sufficiently higher pressure, firing head 408 fires, beginning the explosive train. This leads to shape charge 410 in gun hanger 406 firing, causing slips 412 to retract, and thereby allowing gun hanger 406 to release from casing 418. Gun hanger module 402 and attached seal module 404 are then rapidly pushed downhole by the pressurized stimulation fluids. The stimulation fluids travel to and enter perforations 420 and fracture the formation 422 at perforation faces 430. Additional fluids are pumped downhole as quickly as possible to maintain a high pressure within the created fractures, causing the fractures to lengthen and broaden.

Figure 5C:
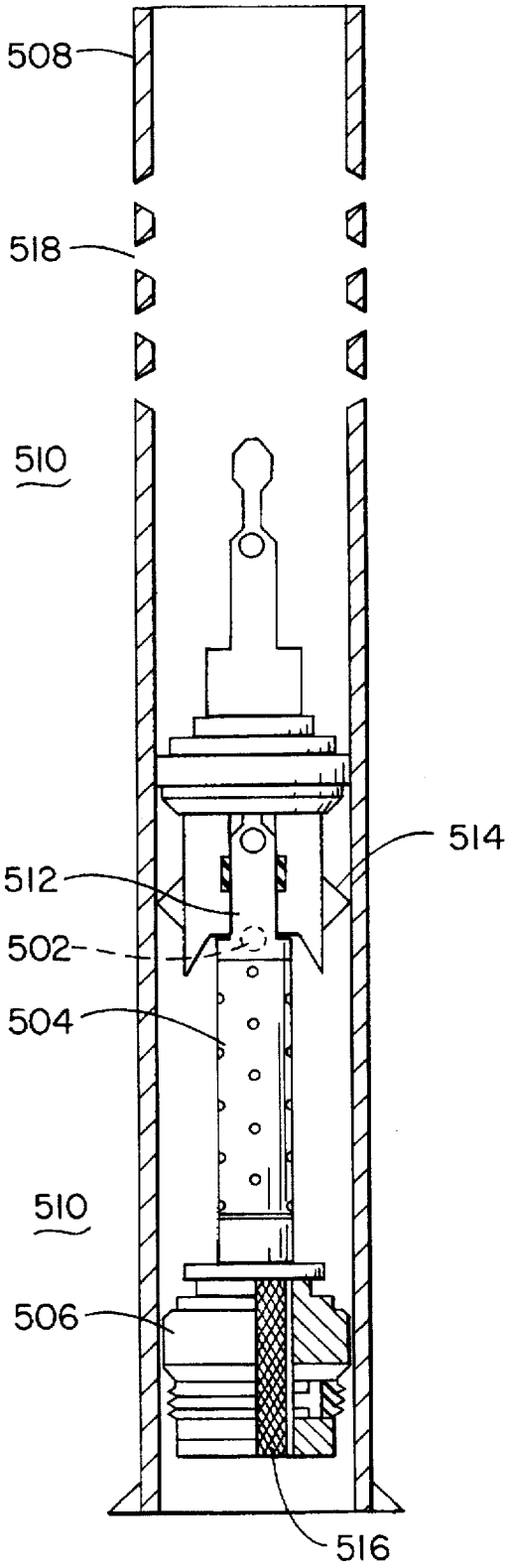
FIG. 5A, 5B & 5C is a schematic illustration of alternative means for practicing the present invention FIG. 6A & B is a schematic illustration of alternative means for practicing the present invention
Figure 5A:
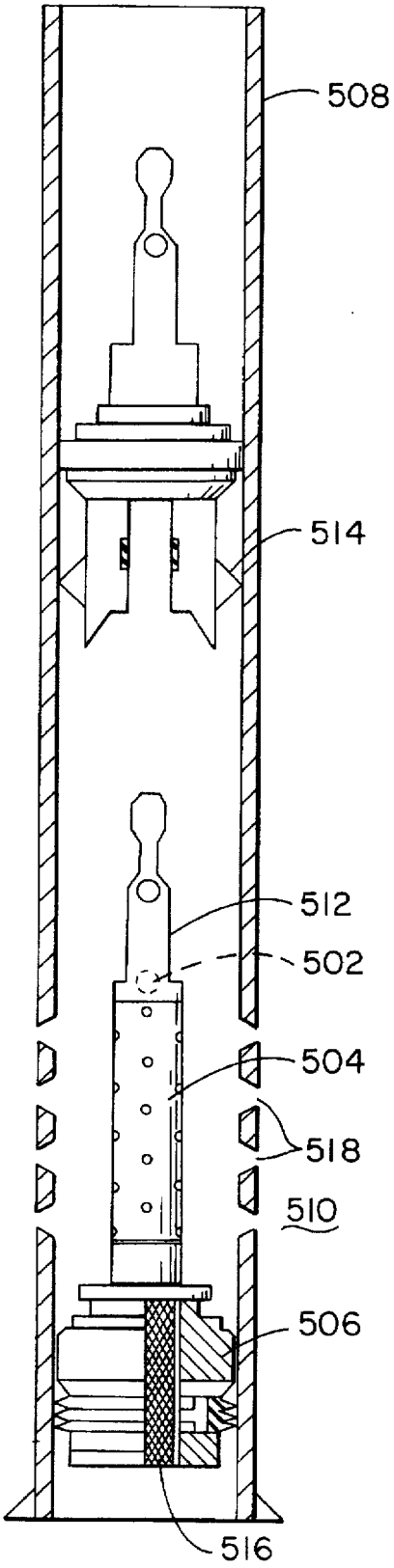
Figure 5B:
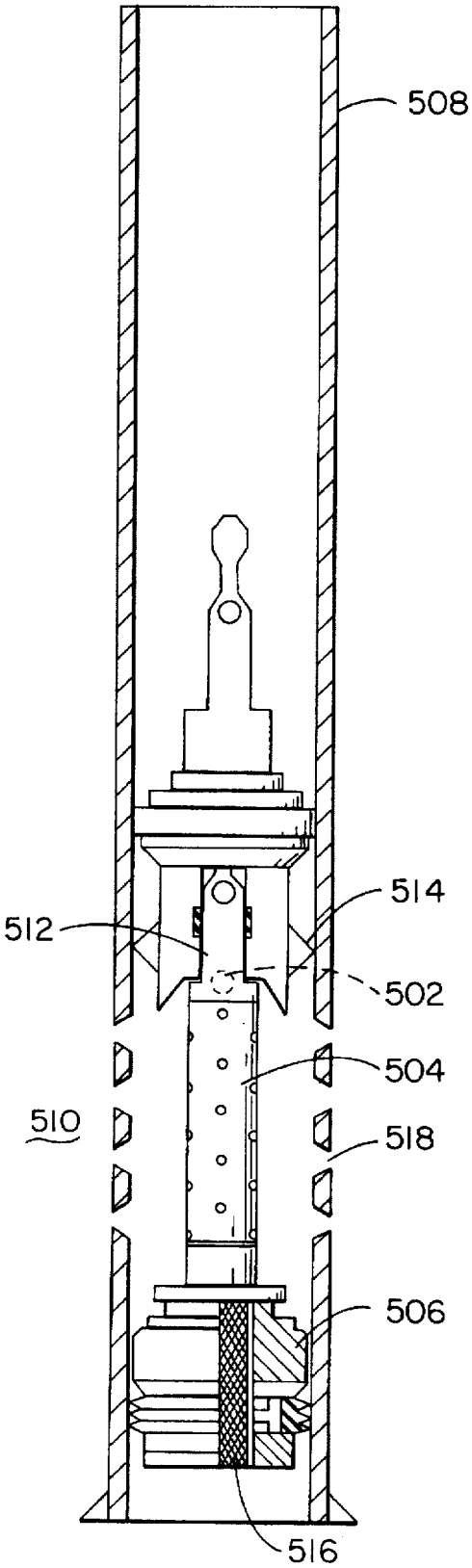

The above described apparatus may also be used when new perforations are going to be added to a well, or existing perforations are being refractured. Referring now to FIG. 5A, B & C, in one embodiment firing head 502 is set above a tubing-conveyed perforating gun 504 (hereinafter a "TCP"), which is set on top of gun hanger 506 in a casing 508, with TCP gun 504 positioned to fire into production formation 510. Above firing head 502 is a seal nipple 512, to which is attached seal module 514. When seal module 514 is set on seal nipple 512, casing 508 above it is filled with stimulation fluids and pressurized. When the fluids are pressurized sufficiently to activate firing head 502, firing head 502 begins the explosive train, which activates TCP gun 504, which then in turn activates shape charge 516 in gun hanger 506. As gun hanger 506 releases, the entire assembly is forced downhole by the pressurized stimulation fluids. Fluids travel to perforations 518 and enter the perforations 518 and fracture the formation 510.

Figures 6A, 6B:
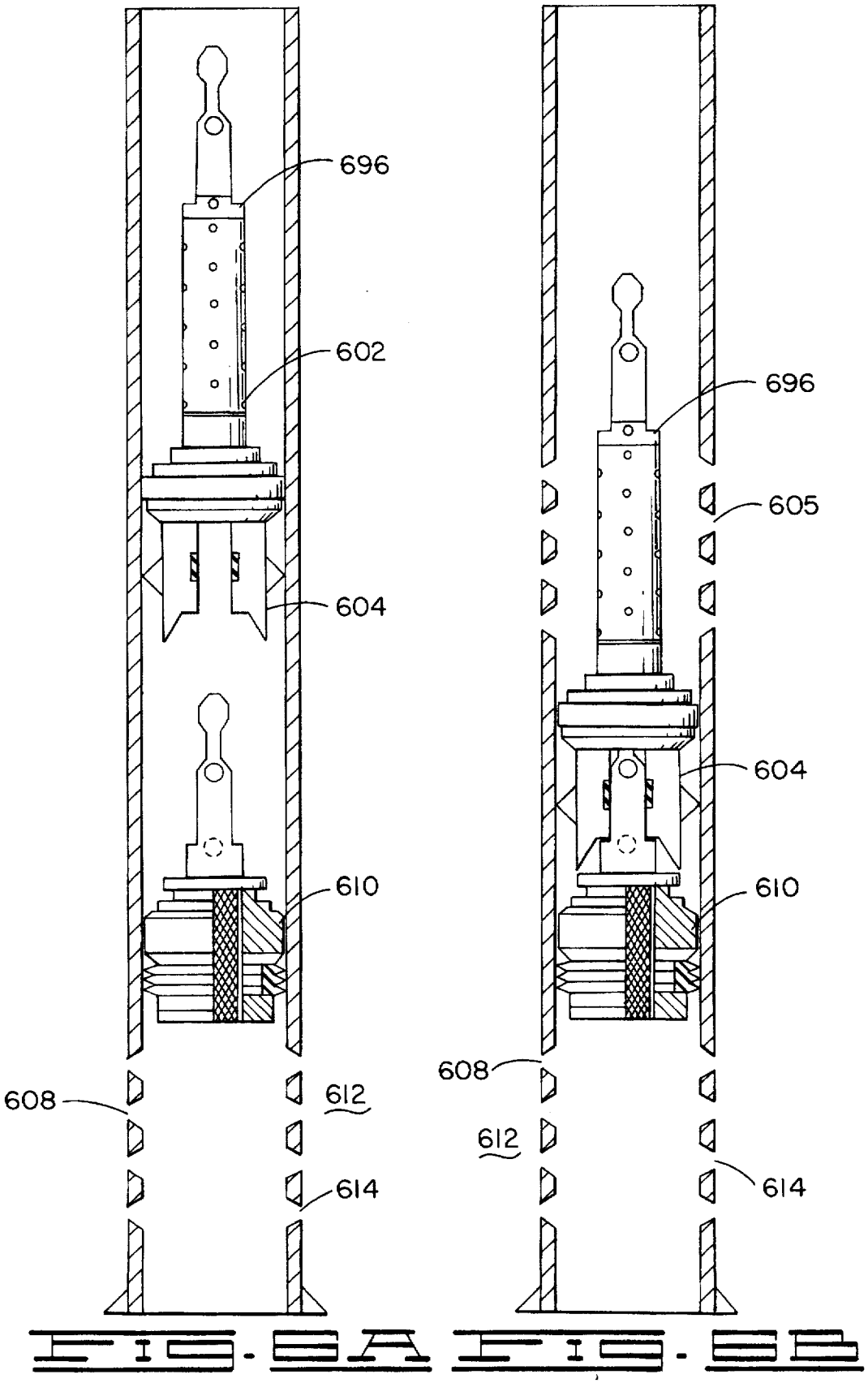

In still another embodiment in which a TCP gun is going to be fired above existing perforations, see FIG. 6A & B, TCP gun 602 may be set above seal module 604, which is set above gun hanger module 610. Thereby, when gun 602 and firing head 696 fire, stimulation fluid entered new perforations 605 immediately, and as gun hanger module 610, seal module 604, and TCP gun 602 travel rapidly downhole, stimulation fluid enters existing perforations 608 upon seal module 604 passing beyond perforations 608, fracturing the formation 612 at perforation faces 614.

The volume of stimulation fluid and proppant material introduced into any well will depend upon the specific conditions present in the well. A sufficient amount is pumped to clean the perforations and create fractures extending into the formation for at least a few feet. Preferably proppant material is introduced into the created fracture to maintain the created flow channel in an open condition at the conclusion of the treatment.

It is to be understood that when reference is made herein to creating new perforations in a casing, it is intended to mean and include creation of perforations in a previously unperforated casing as well as creation of new perforations in a previously perforated casing in which the previous perforations have been sealed off by, for example, squeeze cementing or any other sealing technique. Likewise, unperforated casing is intended to include both new casing and casing in which existing perforations have been sealed off such that no communication from the casing to the zone of interest exists at the relevant time period.

After injection of the stimulation fluid into the formation has ceased, the well may be shut-in for a period of hours to permit the formation to close on the proppant material. Thereafter the well may be opened to production. The waiting period before opening the well to production may vary over significant ranges depending upon which viscosifiers are used in the stimulation fluid.

While the present invention has been described with reference to that which is considered to comprise the preferred embodiments thereof, it is to be understood that changes or modifications may be made in the method and apparatus by those skilled in the art without departing from the spirit or scope of the invention as described above or hereinafter claimed.

What is claimed is:

1. A method of stimulating fluid flow in a subterranean formation around a well having perforated casing fixed therein, the casing extending at least partially through the formation and having at least one perforation in the casing opposite the formation comprising:

placing a fluid in said casing opposite said perforation;

setting a bridging means in the casing above the perforations and said placed fluid in the casing to seal the casing above the perforation from the formation;

injecting a stimulation fluid into the casing above the bridging means in an amount such that when pressure in the casing is released by activation of a pressure release means in said bridging means, the fluid pressure in the well at the depth of the perforation is greater than the fracture pressure of the formation, activating pressure release means in said bridging means such that pressure of said stimulation fluid is substantially instantaneously applied to the formation through said perforation whereby at least one fracture is formed in said formation; and at a time before pressure at the perforation has dropped substantially below the fracturing pressure of the formation, injecting stimulation fluid into said formation at an effective rate to extend the created fracture in said formation.

2. The method of claim 1 wherein said stimulation fluid is a mixture of a gas and an aqueous fluid.

3. The method of claim 1 wherein a proppant material is admixed with said stimulation fluid injected into said formation.

4. The method of claim 1 wherein said aqueous fluid comprises at least one member selected from the group of water, brine and aqueous acid solutions.

5. The method of claim 1 wherein said stimulation fluid includes nitrogen gas.

6. The method of claim 1 wherein said fluid positioned opposite said perforation is an aqueous acid solution.

7. The method of claim 1 wherein the bridging means comprises a bridging means suitable for use with a landing nipple tool and wherein the bridging means comprises:

a) a plug body having means for sealing the plug body within the landing nipple tool;

b) a collet finger having a distal end configured to releasably engage a releasing mandrel tool and the collet finger configured to releasably engage a preselected landing portion located within the landing nipple tool; and c) a pressure release means attached to the plug body for disengaging the plug body and the mandrel tool from the landing nipple tool upon activating the pressure release means.

8. The bridging means of claim 7 wherein the pressure release means comprises: a shearable set assembly having an inner ring partially nested within an outer ring and being releasably secured together by at least one shearable fastener.

9. The method of claim 1 wherein said bridging means and pressure release means is a tool comprising: a mandrel; a bottom most shoe portion secured to the mandrel; a bottom slip and a coacting slip wedge located about the mandrel; a packer element assembly located about the mandrel; an upper slip wedge and a coacting slip located about the mandrel; a hub located about the mandrel; an outer sleeve located about and secured to the mandrel; a temporary, releasable plug located and sealingly secured within the mandrel by shearable means; and a protective releasable bottom plug sealingly installed near the lower most end of the mandrel defining a volumetric cavity between the releasable plug and the protective plug within the mandrel.

10. The method of claim 1, wherein the bridging means comprises a cup-type packing element.

11. The method of claim 1, wherein the pressure release means comprises a firing head.

12. A method of stimulating fluid flow in a subterranean formation around a well having unperforated casing fixed therein, the casing extending at least partially through the formation, comprising:

creating at least one perforation in the casing communicating with the formation;

placing a fluid in said casing opposite said perforation;

setting a bridging means in the casing above said perforation to seal the casing above said means from said formation and said casing below said bridging means;

injecting a stimulation fluid into the casing above the bridging means in an amount such that when pressure in the casing is released, the fluid pressure in the well at the depth of the perforation is greater than the fracture pressure of the formation;

activating pressure release means in said bridging means such that pressure of said stimulation fluid is substantially instantaneously applied to the formation through said perforation whereby at least one fracture is formed in said formation; and injecting additional stimulation fluid into said created fracture to extend the created fracture in the formation.

13. The method of claim 12 wherein said stimulation fluid comprises at least one member selected from the group of a gas, a liquid hydrocarbon or an aqueous fluid.

14. The method of claim 12 wherein said stimulation fluid is a mixture of a gas and an aqueous fluid.

15. The method of claim 12 wherein a proppant material is admixed with said stimulation fluid injected into said formation.

16. The method of claim 12 wherein said stimulation fluid includes nitrogen gas.

17. The method of claim 12 wherein said stimulation fluid positioned opposite said perforation is an aqueous acid solution.

18. The method of claim 12 wherein said bridging means and pressure release means is a tool comprising: a mandrel; a bottom most shoe portion secured to the mandrel; a bottom slip and a coacting slip wedge located about the mandrel; a packer element assembly located about the mandrel; an upper slip wedge and a coacting slip located about the mandrel; a hub located about the mandrel; an outer sleeve located about and secured to the mandrel; a temporary, releasable plug located and sealingly secured within the mandrel by shearable means; and a protective releasable bottom plug sealingly installed near the lower most end of the mandrel defining a volumetric cavity between the releasable plug and the protective plug within the mandrel.

19. The method of claim 12, wherein the bridging means comprises a cup-type packing element.

20. The method of claim 12, wherein the pressure release means comprises a firing head.

21. The method of claim 12 wherein the bridging means comprises a bridging means suitable for use with a landing nipple tool and wherein the bridging means comprises:

a) a plug body having means for sealing the plug body within the landing nipple tool;

b) a collet finger having a distal end configured to releasably engage a releasing mandrel tool and the collet finger configured to releasably engage a preselected landing portion located within the landing nipple tool; and c) a pressure release means attached to the plug body for disengaging the plug body and the mandrel tool from the landing nipple tool upon activating the pressure release means.

22. The bridging means of claim 21 wherein the pressure release means comprises: a shearable set assembly having an inner ring partially nested within an outer ring and being releasably secured together by at least one shearable fastener.

23. A method for stimulating fluid flow in a subterranean formation around a well having perforated casing fixed therein, the casing extending at least partially through the formation and having at least one perforation in the casing opposite the formation comprising:

setting a gun assembly in the casing proximate to the perforation;

setting a bridging means in the casing above the gun assembly and above the perforation, to seal the casing above the gun assembly and perforation from the formation;

injecting a stimulation fluid into the casing above the bridging means in an amount such that when pressure in the casing is released, the fluid pressure in the well at the depth of the perforation is greater than the fracture pressure of the formation;

firing the gun assembly;

activating the pressure release means in the bridging means such that pressure of the stimulation fluid is substantially instantaneously applied to the formation through the perforation whereby at least one fracture is formed in the formation; and at a time before pressure at the perforation has dropped substantially below the fracturing pressure of the formation, injecting stimulation fluid into the formation at an effective rate to extend the created fracture in the formation.

24. The method of claim 23 wherein the pressure release means is activated simultaneously with the firing of the gun assembly.

25. The method of claim 23, wherein the bridging means comprises a cup-type packing element.

26. The method of claim 24, wherein the pressure release means comprises a firing head capable of being activated by application of a pressure in excess of said fracturing pressure of the formation.

27. The method of claim 23, wherein the pressure release means is activated after the firing of the gun assembly.

28. The method of claim 23 wherein the gun assembly comprises a propellant charge.

29. An apparatus for use in stimulating an oilwell, the well have a bore therethrough the oilwell passing through an oil bearing formation, the formation having perforations therein the apparatus comprising:

a gun hanger module, which can be set in the bore; and a seal module, operably connected to the gun hanger module, to seal the bore prior to stimulation and to separate the bore into an upper and lower bore section, the seal module thereby allowing stimulation fluids to be inserted under pressure into the upper bore section and pressurized to a pressure sufficient of fracturing the formation, the stimulation fluids being allowed to enter the perforations when the gun hanger module is activated and releases the seal module.

30. The apparatus of claim 29, wherein the gun hanger module comprises a gun hanger capable of being set rigidly in the bore.

31. The apparatus of claim 29, wherein the gun hanger module further comprises a firing head operably connected to the gun hanger the firing head capable of causing the gun hanger to release from the bore, the firing head being activated by application of a pressure in excess of the fracturing pressure of the formation.

32. The apparatus of claim 31, wherein the gun hanger module further comprises a seal nipple operably connected to the firing head, the seal nipple pressure in the upper bore section to be communicated to the firing head.

33. The apparatus of claim 29 wherein the seal module comprises a cup-type packing element capable of sealing the bore and splitting the bore into the upper and the lower bore sections, the cup-type packing element capable of withstanding pressure in excess of the pressure needed to fracture the formation at the perforations.

34. The apparatus of claim 33, wherein the seal module further comprises:

a seal housing operably connected to the cup-type packing element, to house the cup-type packing element; and, a stinger, the stinger operably connected to the seal housing, the stinger used for running and retrieving the seal module.

35. The apparatus of claim 29, wherein the seal module comprises:

a cup-type packing element capable of sealing the bore and splitting the bore into the upper and the lower bore sections, the cup-type packing element capable of withstanding pressure in excess of the pressure needed to fracture the formation at the perforations.

a seal housing operably connected to the cup-type packing element, to house the cup-type packing element, and a stinger, the stinger operably connected to the seal housing the stinger used for running and retrieving the seal module.

36. The apparatus of claim 29, further comprising a gun assembly operably connected to the gun hanger module, the gun assembly capable of creating additional perforations in the formation.

* * * * *